US009546636B2

(12) United States Patent
Karrar

(10) Patent No.: US 9,546,636 B2
(45) Date of Patent: Jan. 17, 2017

(54) WORK APPARATUS

(71) Applicant: Andreas Stihl AG & Co. KG, Waiblingen (DE)

(72) Inventor: Carel Karrar, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 847 days.

(21) Appl. No.: 13/931,551

(22) Filed: Jun. 28, 2013

(65) Prior Publication Data

US 2014/0000543 A1 Jan. 2, 2014

(30) Foreign Application Priority Data

Jun. 28, 2012 (DE) ..... 10 2012 012 801

(51) Int. Cl.

| | |
|---|---|
| ***F02B 63/02*** | (2006.01) |
| ***B25F 5/00*** | (2006.01) |
| ***F02M 1/16*** | (2006.01) |
| ***F02N 19/00*** | (2010.01) |
| ***F02M 1/02*** | (2006.01) |
| ***F02M 1/08*** | (2006.01) |

(52) U.S. Cl.

CPC ..... *F02N 19/00* (2013.01); *F02M 1/02* (2013.01); *F02M 1/08* (2013.01); *F02B 63/02* (2013.01)

(58) Field of Classification Search

CPC ..... F02N 19/00; F02M 1/02; F02M 1/08; F02B 63/02

USPC ..... 123/179.18

See application file for complete search history.

(56) References Cited

U.S. PATENT DOCUMENTS

| | | | | |
|---|---|---|---|---|
| 4,226,312 | A | 10/1980 | Zindler | |
| 4,460,072 | A | 7/1984 | Moerner et al. | |
| 4,717,207 | A | 1/1988 | Kubota et al. | |
| 4,782,593 | A | 11/1988 | Kieser et al. | |
| 4,936,429 | A | 6/1990 | Mackoway, Jr. et al. | |
| 5,142,934 | A | 9/1992 | Persson et al. | |
| 5,235,943 | A * | 8/1993 | Fiorenza, II | F02N 19/001 123/179.18 |
| 5,774,993 | A * | 7/1998 | Schlessmann | A01G 3/062 30/276 |
| 6,012,420 | A * | 1/2000 | Dykstra | F02D 9/02 123/179.18 |
| 6,536,747 | B2 | 3/2003 | Burns et al. | |
| 7,118,097 | B2 | 10/2006 | Moriyama et al. | |

(Continued)

FOREIGN PATENT DOCUMENTS

| | | |
|---|---|---|
| CN | 200961516 Y | 10/2007 |
| DE | 75 26 726 U | 12/1975 |

(Continued)

*Primary Examiner* — Hieu T Vo
*Assistant Examiner* — Arnold Castro
(74) *Attorney, Agent, or Firm* — Walter Ottesen, P.A.

(57) ABSTRACT

A work apparatus has a work tool and a combustion engine which drives the work tool. The combustion engine has a rotatably mounted crankshaft. The work apparatus has a start enrichment device for the combustion engine. The start enrichment device includes an operating mode selector to be actuated by the operator. The start enrichment device has an operating position and at least one start position. The work apparatus has a reset unit which resets the start enrichment device from the start position into the operating position when the rotational speed of the crankshaft exceeds a reset rotational speed.

11 Claims, 4 Drawing Sheets

(56) References Cited

U.S. PATENT DOCUMENTS

| | | | | |
|---|---|---|---|---|
| 7,337,757 | B2 | 3/2008 | Schmidt et al. | |
| 8,113,166 | B2 | 2/2012 | Kumagai et al. | |
| 8,511,650 | B2 | 8/2013 | Kern et al. | |
| 9,068,533 | B2 | 6/2015 | Kullik et al. | |
| 2002/0112688 | A1 | 8/2002 | Fariz et al. | |
| 2002/0134362 | A1 | 9/2002 | Deutsch | |
| 2005/0022798 | A1* | 2/2005 | Roth | F01N 1/00 123/676 |
| 2006/0070594 | A1 | 4/2006 | Pattullo | |
| 2008/0246170 | A1 | 10/2008 | Engman et al. | |
| 2008/0305929 | A1 | 12/2008 | Koga | |
| 2009/0193669 | A1 | 8/2009 | Gorenflo | |
| 2010/0224466 | A1 | 9/2010 | Leinmueller et al. | |
| 2010/0237516 | A1* | 9/2010 | Kern | F02M 1/02 261/64.6 |
| 2012/0190500 | A1 | 7/2012 | Yamada et al. | |
| 2014/0000542 | A1 | 1/2014 | Karrar et al. | |
| 2014/0000544 | A1 | 1/2014 | Karrar | |
| 2014/0005001 | A1 | 1/2014 | Karrar | |
| 2014/0352660 | A1 | 12/2014 | Kurzenberger et al. | |
| 2014/0366828 | A1 | 12/2014 | Eberle et al. | |

FOREIGN PATENT DOCUMENTS

| | | | |
|---|---|---|---|
| DE | 33 08 400 | A1 | 9/1983 |
| DE | 83 06 837 | U1 | 3/1986 |
| DE | 41 25 846 | A1 | 2/1993 |
| DE | 20 2004 004 467 | U1 | 5/2004 |
| DE | 10 2009 036 372 | A1 | 2/2011 |

* cited by examiner

WORK APPARATUS

CROSS REFERENCE TO RELATED APPLICATION

This application claims priority of German patent application no. 10 2012 012 801.0, filed Jun. 28, 2012, the entire content of which is incorporated herein by reference.

BACKGROUND OF THE INVENTION

DE 10 2009 036 372 A1 discloses a portable work apparatus, specifically a motor-driven chain saw, in which a start position is settable via an operating mode selector. In order to ensure that the rotational speed does not rise above the engaging rotational speed during the starting operation, means for detecting the start position are provided.

In work apparatuses which are operated with a carburetor having a starting throttle latch, it is known to release the starting throttle latch when the operator actuates the throttle lever.

SUMMARY OF THE INVENTION

It is an object of the invention to provide a work apparatus which has a simple structure and in which operating errors are avoided.

The work apparatus of the invention includes: a housing; a work tool; a combustion engine having a rotatably mounted crankshaft and being arranged in the housing and configured to drive the work tool; a starting enrichment unit configured for the combustion engine and having an operating mode selector configured to be actuated by an operator; the starting enrichment unit having an operating position and at least one starting position; and, a reset unit configured to reset the starting enrichment unit from the starting position to the operating position when the crankshaft assumes a rotational speed which exceeds a reset rotational speed.

The reset unit ensures that the start position does not remain engaged when the rotational speed of the crankshaft of the combustion engine of the work apparatus exceeds a reset rotational speed. As a result, the start position can be released in an easy manner.

Advantageously, the reset unit blocks an adjustment of the start enrichment device into a start position at a rotational speed above the reset rotational speed. In this case, the reset rotational speed is preferably below the usual operating rotational speed. As a result, it is easily possible to prevent the start enrichment device being accidentally positioned in the start position by the operator during normal operation.

A simple structure is achieved when the reset unit has an actuating element which is adjustable between an actuated and an unactuated position. The actuating element is in this case advantageously mounted in a fixed position in the housing, that is does not rotate together with the crankshaft of the drive motor or a driveshaft of the work tool. The position of the start enrichment device is in this case advantageously coupled to the position of the actuating element. The actuating element is in the unactuated position in particular when the start enrichment device is in the start position and in the actuated position when the start enrichment device is in the operating position. This ensures in a simple manner that, when the actuating element is in the actuated position the start enrichment device is always in the operating position and not in the start position.

A simple structure results when the reset unit includes a cam which is operatively connected to the crankshaft at rotational speeds above the reset rotational speed and which acts on the actuating element. The cam can in this case always be operatively connected to the crankshaft and rotate therewith. However, it is also possible to provide for the cam to be connected downstream, for example, of a clutch of the work apparatus, the clutch engaging only at or above the reset rotational speed so that the cam is operatively connected to the crankshaft only above the reset rotational speed. The combustion engine is operatively connected to the work tool advantageously via a clutch that shifts in a rotational speed-dependent manner, in particular via a centrifugal clutch.

It may be provided for the cam to be arranged on the drive side of the clutch. The position of the cam is advantageously dependent on the rotational speed of the crankshaft. This can be achieved in a simple manner in that the cam is arranged on a flyweight of the clutch in the form of a centrifugal clutch. When the rotational speed rises, the flyweight moves outwardly away from the rotational axis. This movement of the flyweight can be used to actuate the actuating element.

Advantageously, in the unactuated position, the actuating element is at a distance from the rotational axis of the clutch which is greater than the outer distance of the cam from the rotational axis at rotational speeds below the reset rotational speed. The outer distance of the cam is in this case the distance of the outer circumference, arranged next to the actuating element, of the cam, that is the region of the cam which is at the greatest distance from the rotational axis and can come into contact with the actuating element, that is has no offset in the direction of the rotational axis with respect to the actuating element. At a rotational speed below the reset rotational speed, on account of the smaller distance from the rotational axis, the cam cannot come into contact with the actuating element and cannot actuate the latter. The actuating element is arranged radially outside the cam with respect to the rotational axis of the crankshaft. The actuating element is accordingly arranged outside a circle on which the outer region of the cam moves. At a rotational speed above the reset rotational speed, the cam is advantageously at a greater outer distance from the rotational axis than the actuating element in the unactuated position and adjusts the actuating element into the actuated position. At rotational speeds above the reset rotational speed, on account of the rapid rotation, the circular path which the outer region of the cam describes acts like a fixed boundary which prevents the actuating element from being able to be positioned back in the unactuated position. As a result, adjustment of the operating mode selector into the start position is prevented at rotational speeds above the reset rotational speed.

It may be provided for the reset rotational speed to be an engaging rotational speed of the clutch. The reset rotational speed is advantageously the rotational speed at which the clutch begins to engage, that is the output side and the work tool begin to move. Advantageously, the rotational movement of the output side of the clutch is utilized as an actuating movement for resetting the start enrichment device. The cam is in particular arranged on the output side of the clutch and the outer distance of the cam from the rotational axis of the clutch is smaller than the distance of the actuating element from the rotational axis in the unactuated position of the actuating element. As soon as the output side of the clutch has been set in rotation, because the clutch is engaged, the cam actuates the actuating element during the first rotation of the output side of the clutch and adjusts the actuating element into the actuated position. In particular, the clutch has a clutch drum to which the cam is secured.

Advantageously, combustion air is supplied to the combustion engine via an intake channel. In particular at least one adjustable valve element is arranged in the intake channel, wherein the start enrichment device acts on the position of the valve element. The valve element can be a throttle element or a choke element. The start enrichment device can also act both on a throttle element and on a choke, element and adjust them into a suitable start position.

The rotational speed of the crankshaft can alternatively be captured via other devices. For example, the rotational speed of the crankshaft may be captured via a sensor and the start enrichment device may be reset into the operating position depending on the sensor signal. In the case of work apparatuses which have an oil pump for delivering lubricating oil for the operation of the work tool, it is alternatively possible for the oil pressure to be utilised as a parameter for the rotational speed of the crankshaft. The oil can act on a spring-loaded actuating element which is adjusted depending on the oil pressure. Other parameters of the work apparatus, which allow a conclusion to be drawn about the rotational speed of the crankshaft, can be utilized to actuate the reset unit.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
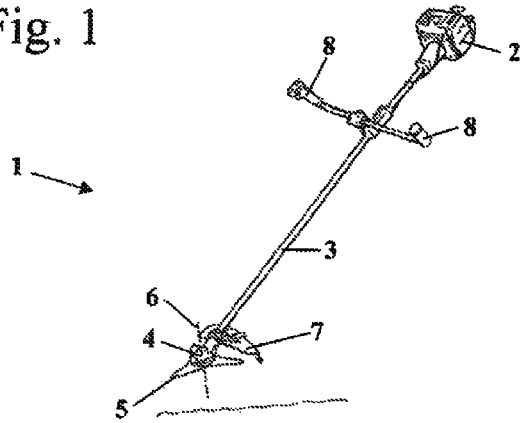
FIG. 1 shows a schematic perspective view of a brushcutter.

FIG. 1 shows a handheld work apparatus, specifically a brushcutter 1 as an exemplary embodiment of a work apparatus. The present invention can also be used in work apparatuses other than a brushcutter, for example motor-driven chain saws, cut-off machines or the like. The brushcutter 1 has a guide wand 3. A motor housing 2 is arranged at that end of the guide wand 3 which is located away from the ground during operation. A cutter head 4, which carries a work tool 5, is arranged at that end of the guide wand 3 which is opposite the motor housing 2 and faces the ground. In the exemplary embodiment, the work tool 5 is a blade. However, some other work tool, for example a string trimmer head or the like, may be provided instead of the blade 5. During operation, the work tool 5 rotates about a rotational axis 6 which is transverse to the longitudinal axis of the guide wand 3. A guard 7, which shields the work tool 5 in the direction of the motor housing 2 and in the direction of an operator of the brushcutter 1, is secured next to the cutter head 4 on the guide wand 3. Secured to the guide wand 3 is a handle frame having two handles 8 for guiding the brushcutter 1.

Figure 2:
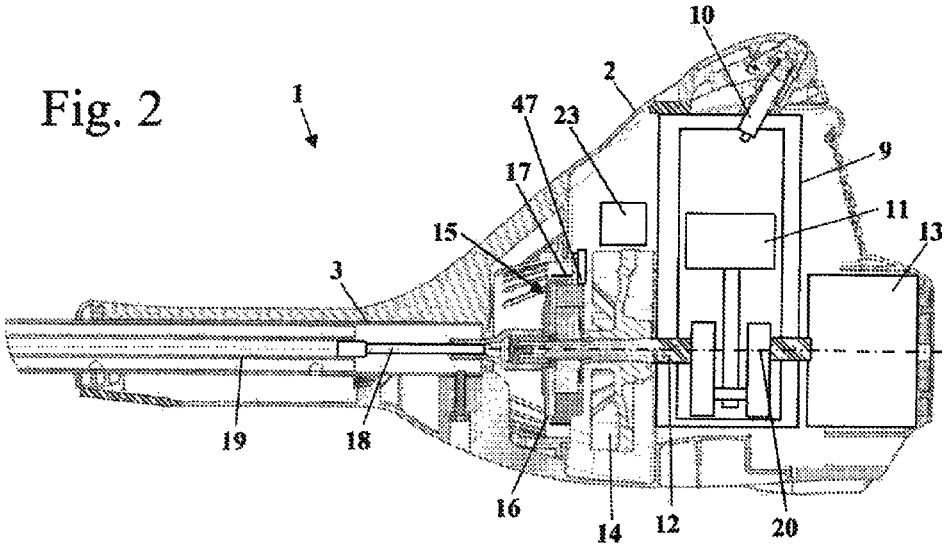
FIG. 2 shows a schematic section through the motor housing of the brushcutter of FIG. 1.

As FIG. 2 shows, a combustion engine 9 is arranged in the motor housing 2. The combustion engine 9 has a piston 11 which drives a crankshaft 12 in rotation about a rotational axis 20. The combustion engine 9 also has a spark plug 10 for igniting the fuel/air mixture. In order to start the combustion engine 9, a starter device 13 is provided which can, for example, be in the form of a pull-rope starter or of an electric starter device. On the side of the combustion engine 9 which is opposite the starter device 13, a fan wheel 14 is secured to the crankshaft 12. The fan wheel 14 carries magnets (not shown) which induce the ignition voltage for the spark plug 10 in an ignition module 23 arranged at the outer circumference of the fan wheel 14. Also fixed to the crankshaft 12 is a centrifugal clutch 15. The centrifugal clutch 15 has a clutch drum 16 which is arranged on the output side of the centrifugal clutch 15 and is connected via a coupling element 18 to a drive shaft 19 that is guided through the guide wand 3. The blade 5 is driven via the drive shaft 19. A brake band 17, which is part of a braking device (not shown), can be arranged on the outer circumference of the clutch drum 16.

Figure 3:
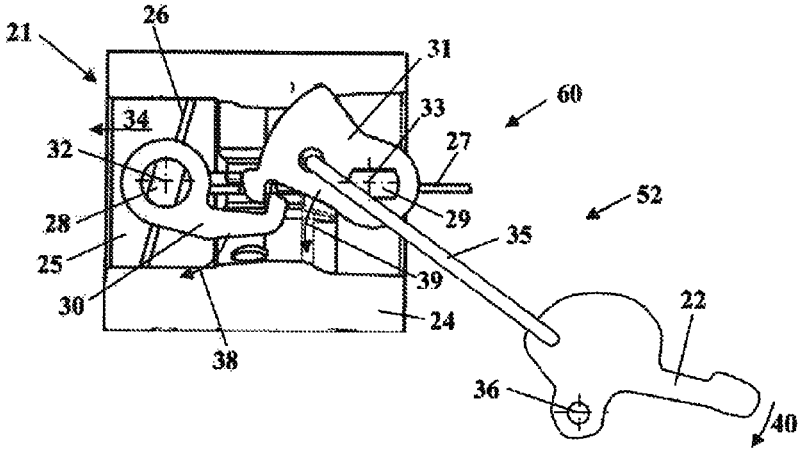
FIG. 3 shows the start enrichment device of the brushcutter of FIG. 1 in the operating position.

Fuel/air mixture is supplied to the combustion engine 9 via the carburetor 21 shown in FIG. 3. The combustion engine 9 is advantageously a mixture-lubricated engine, in particular a single cylinder engine. Advantageously, the combustion engine 9 is a two-stroke engine. The carburetor 21 has a carburetor housing 24 in which an intake channel 25 is formed. Via the intake channel 25, fuel/air mixture is drawn into the combustion engine 9 during operation. The fuel can be drawn into the intake channel on account of the negative pressure prevailing in the intake channel 25. However, electronic metering of the fuel into the intake channel 25 can also be provided. It can also be provided for the fuel to be supplied directly into the combustion engine 9, in particular into the crankcase of the combustion engine 9, via a fuel valve. In this case, the carburetor 21 is configured merely as a throttle device for controlling the amount of air supplied to the combustion engine 9 and not as a mixture-forming device.

In the intake channel 25, a throttle flap 26 is mounted in a pivotable manner about a pivot axis 32 by way of a throttle shaft 28. Outside the carburetor housing 24, a throttle trigger 30 is secured to the throttle shaft 28. In FIG. 3, the intake channel 25 is shown in a manner open toward the throttle trigger 30 in order to facilitate showing the structure. In the actual configuration, the intake channel 25 is in the form of a tube through the carburetor housing 24 and the throttle trigger 30 is arranged on the outer side of the carburetor housing 24.

FIG. 3 shows the throttle flap 26 in the idling position. Upstream of the throttle flap 26, with regard to the direction of flow 65 in the intake channel 25, a choke flap 27 is mounted in the intake channel 25 in a pivotable manner about a pivot axis 33 by way of a choke shaft 29. Outside the carburetor housing 24, a choke lever 31 is secured to the choke shaft 29. The choke lever 31 interacts with the throttle trigger 30. A coupling rod 35, which couples the position of the choke lever 31 to the position of an operating mode selector 22, acts on the choke lever 31. The operating mode selector 22 is pivotably mounted about a pivot axis 36. The operating mode selector 22 and the coupling rod 35 are part of a start enrichment device 60. In FIG. 3, the start enrichment device 60 is shown in an operating position 52. In the operating position, the choke flap 27 is completely open and the throttle flap 26 is in its idling position.

Figure 4:
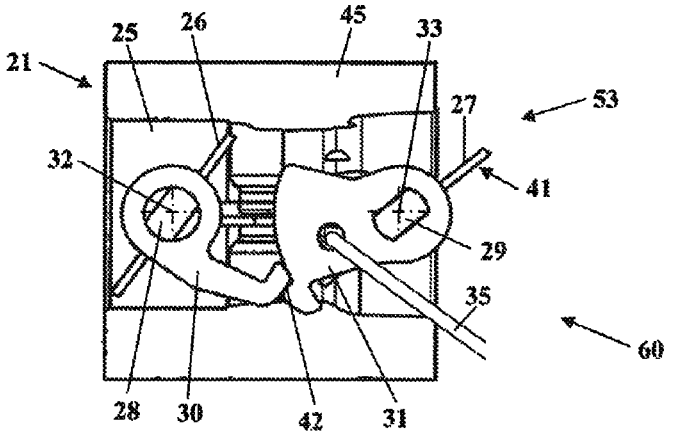
FIG. 4 is a schematic of the start enrichment device in the start position.

In order to start the combustion engine 9, the start enrichment device is adjusted into a start position, for example, a warm start position or a cold start position. In order to adjust the start enrichment device 60 into a start position, a throttle lever (not shown) of the brushcutter 1 has to first be pressed by the operator. As a result, the throttle trigger 30 is pivoted out of the pivoting range of the choke lever 31, as is indicated in FIG. 3 by the arrow 38. Subsequently, the operating mode selector 22 is actuated by the operator and pivoted in the direction of the arrow 40, as a result of which the choke lever 31 pivots in the direction of the arrow 39 and the choke flap 27 is adjusted into the start position 41 shown in FIG. 4. In the start position 41, the choke flap 27 partially closes the flow cross section of the intake channel 25. In the start position 53, shown in FIG. 4, of the start enrichment device 60, the throttle flap 26 is slightly open. In order to keep the throttle flap 26 in this position, the throttle trigger 30 rests against a shoulder 42 of the choke lever 31. The throttle trigger 30 is spring-loaded in the direction of the completely closed position of the throttle flap 26 and the choke lever 31 is spring-loaded in the direction of the completely open position of the choke flap 27. On account of the configuration of the throttle trigger 30 and choke lever 31 and the spring-loading of the choke lever 31 and throttle trigger 30, the trigger 30 and the lever 31 mutually fix one another in the start position 53 of the start enrichment device 60. The start position 53 shown in FIG. 4 is a warm start position. In addition, the start enrichment device 60 can have a cold start position. In the cold start position, the choke flap 27 is advantageously completely closed so that combustion air can flow only through openings in the choke flap 27.

Figure 5:
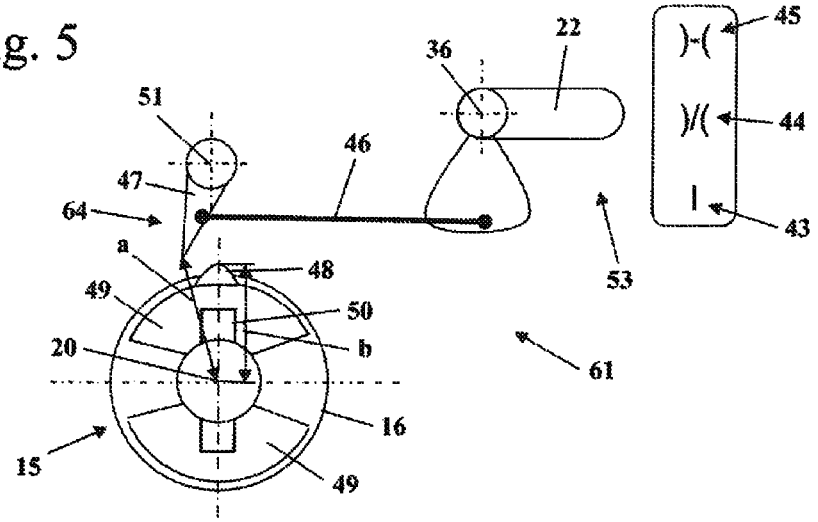
FIG. 5 is a schematic of the reset unit of the brushcutter in the unactuated position of the actuating element.

FIG. 5 schematically shows a reset unit 61 of the brushcutter 1. The reset unit 61 resets the start enrichment device 60 from the start position 53 into the operating position 52 when the rotational speed of the crankshaft 12 exceeds a reset rotational speed. The reset rotational speed is advantageously within an engaging rotational speed range between a lower and an upper engaging rotational speed. The centrifugal clutch 15 has flyweights 49 which are guided outwardly away from the rotational axis 20 on guides 50 during their movement. A cam 48 is arranged on the outer circumference of one of the flyweights 49. In the start position 53, shown in FIG. 5, of the start enrichment device 60, the operating mode selector 22 is in a position which is assigned to a warm start symbol 44.

The operating mode selector 22 can also be positioned in an operating position and a cold start position. Accordingly, an operating symbol 43 for the operating position and a cold start symbol 45 for the cold start position are arranged on the brushcutter 1, for example, on the motor housing 2, and are shown schematically in FIG. 5. The operating mode selector 22 is coupled to an actuating element 47 via a coupling element, in the exemplary embodiment a coupling rod 46. Each position of the operating mode selector 22 is assigned a position of the actuating element 47. In the event of a movement of the operating mode selector 22, the actuating element 47 also moves and vice versa. In the exemplary embodiment, the coupling rod 46 is designed to be rigid at the forces that act during operation. However, the coupling element may also be resiliently elastic at the acting operating forces. As a result, stresses are avoided during a rotary movement of the combustion engine 9 in the opposite direction of rotation, that is counter to the direction of rotation, indicated by way of the arrow 37 in FIG. 6, during normal operation. The spring stiffness of the coupling element should be adapted so as to ensure the function during operation. The actuating element 47 is in the form of an actuating lever which, is mounted in a pivotable manner about a pivot axis 51. As FIG. 2 shows, the actuating element 47 is mounted in a fixed and pivotable manner on the motor housing 2. During operation, the actuating element 47 does not rotate together with the crankshaft 12 or the drive shaft 19.

In FIG. 5, the actuating element 47 is arranged in an unactuated position 64. The rotational speed of the crankshaft 12 and thus also that of the centrifugal clutch 15 are below a reset rotational speed. The reset rotational speed is advantageously a rotational speed which corresponds to an engaging rotational speed of the centrifugal clutch 15. The centrifugal clutch 15 has an engaging rotational speed range which extends from a lower rotational speed at which the flyweights 49 begin to move outward up to an upper engaging rotational speed at which the flyweights 49 rest against the clutch drum 16. The reset rotational speed is advantageously within this rotational speed range, in particular in the region of the upper engaging rotational speed.

As FIG. 5 shows, the cam 48 has a distance (b) from the rotational axis 20 in its outer region remote from the rotational axis. The actuating element 47 has, in the unactuated position 64 shown in FIG. 5, a smallest distance (a) from the rotational axis 20 in its region facing the rotational axis 20. The distance (a) is greater than the distance (b), so that the cam 48 does not come into contact with the actuating element 47 during a rotation of the crankshaft 12 about the rotational axis 20.

Figure 6:
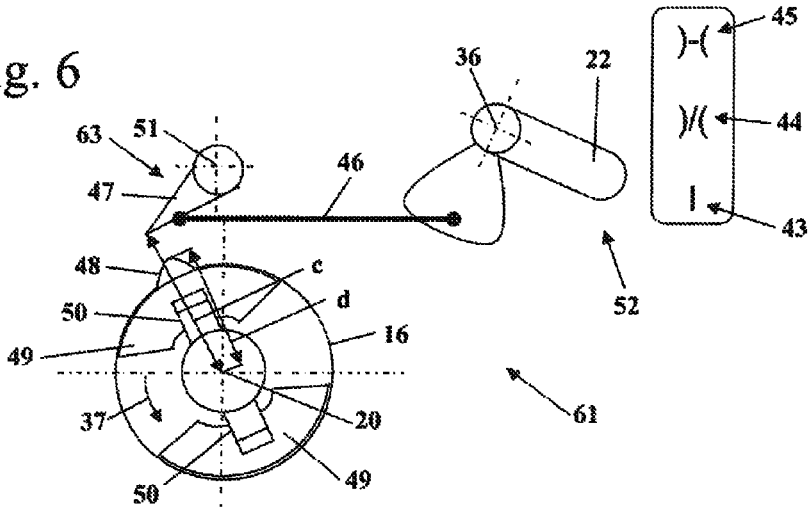
FIG. 6 shows the reset unit of FIG. 5 in the actuated position of the actuating element.

FIG. 6 shows the reset unit 61 at a rotational speed of the crankshaft 12 which is above the reset rotational speed. The flyweights 49 have moved radially outward with respect to the rotational axis 20. The cam 48 has a greatest distance (d) from the rotational axis 20, this greatest distance (d) being greater than the distance (b) (FIG. 5) and also greater than the distance (a) of the actuating element 47 in the unactuated position 64 from the rotational axis 20 (FIG. 5). The cam 48 has adjusted the actuating element 47 into its actuated position 63 in the direction of the arrow 37 (FIG. 6) during the rotation of the crankshaft 12. In the actuated position 63, the actuating element 47 has a smallest distance (c) from the rotational axis 20, this smallest distance (c) being greater than the distance (d) in the exemplary embodiment. As a result of a correspondingly configured latching position of the operating mode selector 22 and/or actuating element 47, it is possible for the actuating element 47 to be positioned further outward than the cam 48 pushes the actuating element 47 outward. This ensures that the actuating element 47 is not permanently actuated by the cam 48 during operation. As a result, wear and noise can be kept low. In the actuated position 63 of the actuating element 47, the operating mode selector is in a position which is assigned to the operating symbol 43. The start position 53 of the choke flap 27 and throttle flap 26 is released in this position of the operating mode selector 22. The start enrichment device 60 is in the operating position 60 shown in FIG. 3.

Figure 7:
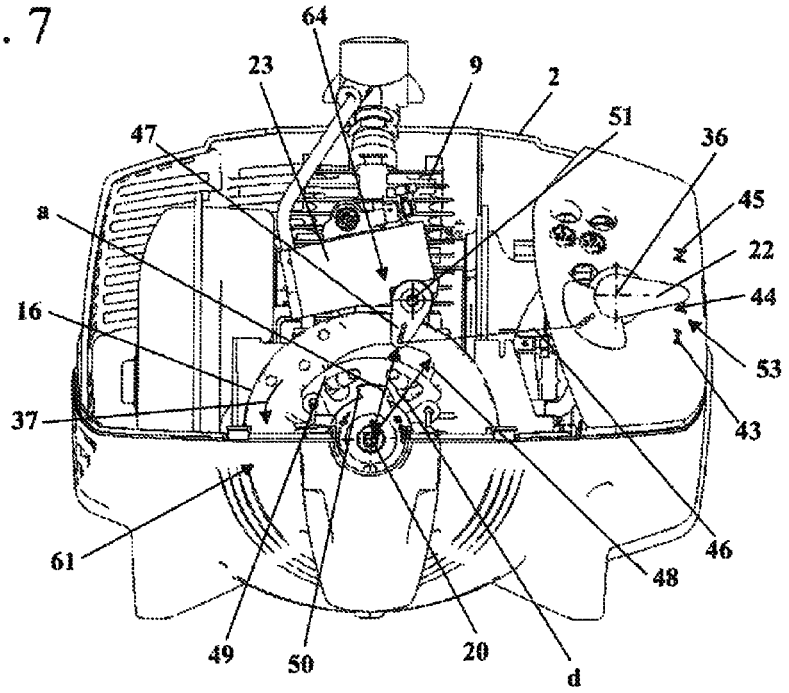
FIG. 7 shows a partially sectional view of the motor housing of the brushcutter with the starter device in the start position.
Figure 8:
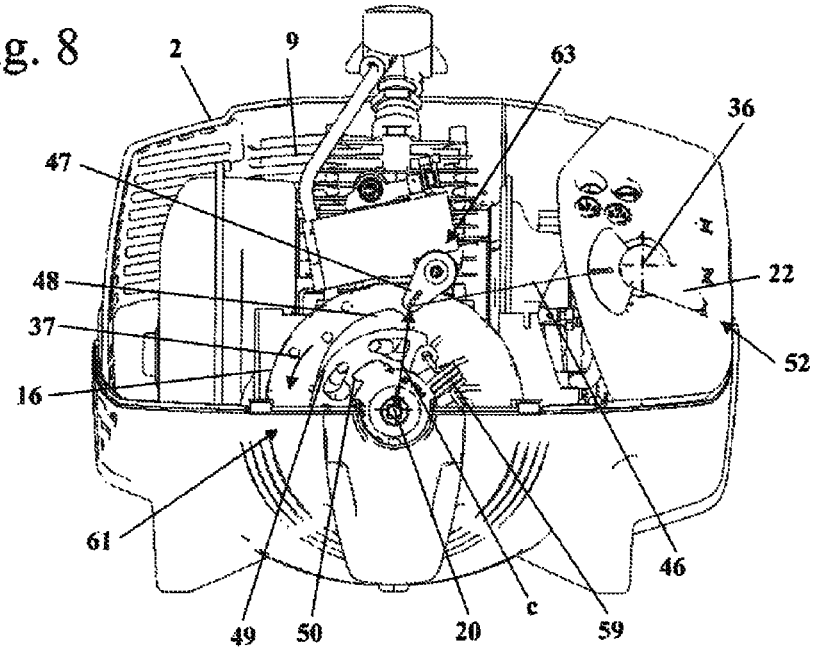
FIG. 8 shows the brushcutter of FIG. 7 with the starter device in the operating position.

FIGS. 7 and 8 show a structural design for the reset unit 61. In FIG. 7, the reset unit 61 is shown in the unactuated position of the actuating element 47 at a rotational speed above the reset rotational speed. The cam 48 rests against the actuating element 47. The operating mode selector 22 is in a position assigned to the warm start symbol 44. The actuating element 47 has a distance (a) from the rotational axis 20, this distance (a) being smaller than the distance (d) of the cam 48 from the rotational axis 20. As FIG. 7 shows, the cam 48 is in the form of a shallow ramp in order to keep an impact against the actuating element 47 during the adjustment into the actuated position 63 as small as possible.

FIG. 8 shows the reset unit 61 after the crankshaft 12 has been rotated further through a few angular degrees in the direction of the arrow 37. The cam 48 has moved past the actuating element 47 and in the process has pivoted the actuating element 47 outward with respect to the rotational axis 20. The actuating element 47 is in the actuated position 63 in FIG. 8, while the actuating element 47 is shown in the unactuated position 64 in FIG. 7. During pivoting into the actuated position 63, the actuating element 47 has also adjusted the operating mode selector 22 into the operating position 52 via the coupling rod 46. As a result, the start position of the start enrichment device 60 was released and the throttle flap 26 and choke flap 27 (FIG. 3) were reset into the unactuated position. Resetting from the latched position can be allowed for example by the throttle trigger 30 (FIG. 3) being made of an elastic material.

FIG. 8 also shows a spring 59 of the centrifugal clutch 15, which acts on the flyweight 49. In the exemplary embodiment shown in FIGS. 7 and 8, the guides 50 of the flyweights 49 extend in an inclined manner such that the flyweights 49 move outwardly in the circumferential direction during their travel from the rotational axis 20.

Figure 9:
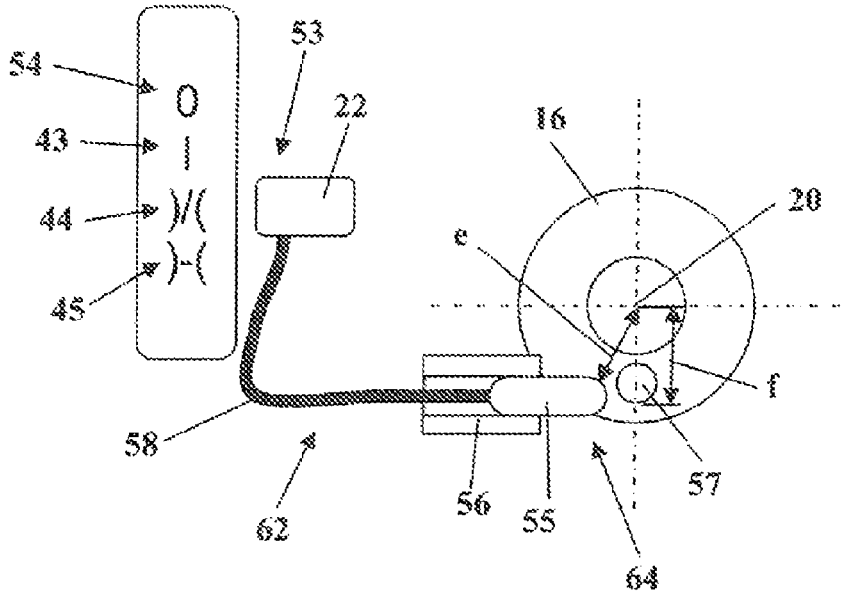
FIG. 9 is a schematic of an exemplary embodiment of a reset unit with the actuating element in the unactuated position; and, FIG. 10 is the schematic of FIG. 9 with the actuating element in the actuated, position.
Figure 10:
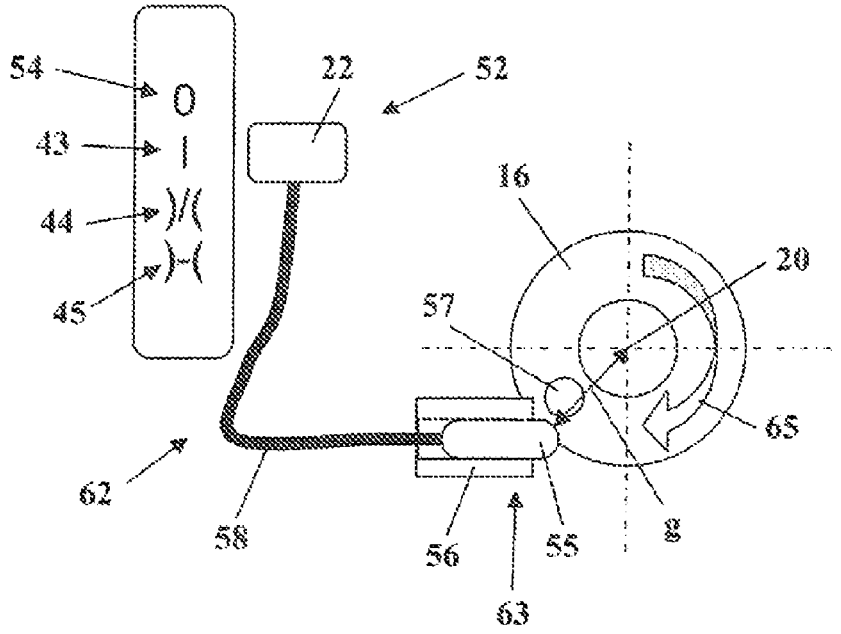

FIGS. 9 and 10 show a reset unit 62 which can be provided instead of a reset unit 61. Identical reference numerals to those in the preceding figures designate corresponding elements. The reset unit 62 has a cam 57 which is fixed on the output side of the centrifugal clutch 15, specifically on the clutch drum 16. The cam 57 moves together with the clutch drum 16 only when the flyweights 49 (FIGS. 5 to 8) rest against the clutch drum 16 and begin to carry the latter along. FIG. 9 shows the reset unit 62 in the start position 53 of the start enrichment device 50. As FIG. 9 shows, a stop position for the operating mode selector 22 is additionally provided and is assigned a stop symbol 54. In the stop position, the operating mode selector 22 short-circuits the ignition of the combustion engine 9. The operating mode selector 22 is connected to an actuating element 55 via a coupling element 58 which is shown only schematically in FIGS. 9 and 10. The coupling element 58 can, for example, be a coupling rod, a Bowden cable, a lever linkage or the like. The actuating element 55 is mounted in a longitudinally displaceable manner in a guide 56. However, the actuating element 55 can alternatively also be configured as a pivotable actuating lever or the like.

In the unactuated position 64, shown in FIG. 9, of the actuating element 55, the actuating element 55 has a distance (e) from the rotational axis 20. In its outer region, provided at a distance from the rotational axis 20, for actuating the actuating element 55, the cam 57 has a distance (f) from the rotational axis 20. As long as the rotational speed of the crankshaft 12 is below the rotational speed at which the clutch drum 16 is carried along by the flyweights 49, the cam 57 does not move relative to the actuating element 55 and the start enrichment device 60 remains in its start position 53. As soon as the rotational speed increases above the engaging rotational speed and the clutch drum 16 co-rotates in the direction of the arrow 65 shown in FIG. 10, the cam 57 comes into contact with the actuating element 55 and displaces the latter into its actuated position 63. The operating mode selector 22 is adjusted into its operating position 52 via the coupling element 58. In the actuated position 63, the actuating element 55 has a distance (g) from the rotational axis 20, which is advantageously somewhat greater than the distance (f) of the cam 57. This can be achieved by a corresponding latching position of the actuating element 55. This prevents the cam 57 from coming into contact with the actuating element 55 during each rotation of the clutch drum 16.

The cams 48 and 57 also prevent the operating mode selector 22 from being able to be positioned in the start position 53 of the start enrichment device 60 during operation when the rotational speed is above the reset rotational speed. The cams 48 and 57 come into contact with the actuating elements 47 and 55, respectively, during an adjustment of the operating mode selector 22. Since the crankshaft 12 and the centrifugal clutch 15 rotate comparatively quickly, specifically at a rotational speed above the reset rotational speed, the cams 48 and 57 act as a continuous boundary (that is, rotationally symmetrical with respect to the rotational axis 20) and prevent displacement of the actuating elements 47 and 55, respectively. The possibility of the operating mode selector 22 being reset into the start position 53 during operation is easily avoided as a result.

It is understood that the foregoing description is that of the preferred embodiments of the invention and that various changes and modifications may be made thereto without departing from the spirit and scope of the invention as defined in the appended claims.

What is claimed is:

1. A work apparatus comprising:

a housing;

a work tool;

a combustion engine having a rotatably mounted crankshaft and being arranged in said housing and configured to drive said work tool;

a starting enrichment unit configured for said combustion engine and having an operating mode selector configured to be actuated by an operator;

said starting enrichment unit having an operating position and at least one starting position;

said operating mode selector being configured to set said starting enrichment unit to said at least one starting position;

a reset unit configured to reset said starting enrichment unit from said at least one starting position to said operating position when said crankshaft assumes a rotational speed which exceeds a reset rotational speed; and, said reset unit being configured to block said starting enrichment unit from shifting into said starting position at a rotational speed exceeding said reset rotational speed.

2. The work apparatus of claim 1 further comprising:

an intake channel configured to supply air to said combustion engine;

at least one valve element arranged in said intake channel and having an adjustable valve position; and, said starting enrichment unit being configured to adjust said valve position of said valve element.

3. The work apparatus of claim 1, wherein:

said reset unit has an actuating element which is shiftable between an actuated position and an unactuated position; and, said actuating element is configured to be in said unactuated position when said starting enrichment unit is in said starting position and to be in said actuated position when said operating mode selector is in said actuated position.

4. The work apparatus of claim 3, wherein said reset unit has a cam configured to, above said reset rotational speed, be operatively connected to said crankshaft and act on said actuating element.

5. The work apparatus of claim 4 further comprising:

a clutch configured to shift in dependence upon the rotational speed; and, said combustion engine being operatively connected to said work tool via said clutch.

6. A work apparatus comprising:

a housing;

a work tool;

a combustion engine having a rotatably mounted crankshaft and being arranged in said housing and configured to drive said work tool;

a starting enrichment unit configured for said combustion engine and having an operating mode selector configured to be actuated by an operator;

said starting enrichment unit having an operating position and at least one starting position;

a reset unit configured to reset said starting enrichment unit from said starting position to said operating position when said crankshaft assumes a rotational speed which exceeds a reset rotational speed;

said reset unit having an actuating element which is shiftable between an actuated position and an unactuated position;

said actuating element being configured to be in said unactuated position when said starting enrichment unit is in said starting position and to be in said actuated position when said operating mode selector is in said actuated position;

said reset unit having a cam configured to, above said reset rotational speed, be operatively connected to said crankshaft and act on said actuating element;

a clutch being configured to shift in dependence upon the rotational speed;

said combustion engine being operatively connected to said work tool via said clutch;

said clutch having a drive side; and, said cam being arranged on said drive side of said clutch.

7. The work apparatus of claim 6, wherein:

said clutch is a centrifugal clutch having at least one flyweight; and, said cam is fixed on said flyweight.

8. The work apparatus of claim 6, wherein:

said clutch defines a rotational axis;

said actuating element is at a distance (a) to said rotational axis when in said unactuated position;

said cam is at a distance (b) to said rotational axis at rotational speeds below said reset rotational speed;

said distance (a) is greater than said distance (b);

at rotational speeds above said reset rotational speed, said cam is configured to be at a distance (d) to said rotational axis and displace said actuating element into said actuated position; and, said distance (d) is greater than said distance (a).

9. A work apparatus comprising:

a housing;

a work tool;

a combustion engine having a rotatably mounted crankshaft and being arranged in said housing and configured to drive said work tool;

a starting enrichment unit configured for said combustion engine and having an operating mode selector configured to be actuated by an operator;

said starting enrichment unit having an operating position and at least one starting position;

a reset unit configured to reset said starting enrichment unit from said starting position to said operating position when said crankshaft assumes a rotational speed which exceeds a reset rotational speed;

said reset unit having an actuating element which is shiftable between an actuated position and an unactuated position;

said actuating element being configured to be in said unactuated position when said starting enrichment unit is in said starting position and to be in said actuated position when said operating mode selector is in said actuated position;

said reset unit having a cam configured to, above said reset rotational speed, be operatively connected to said crankshaft and act on said actuating element;

a clutch configured to shift in dependence upon the rotational speed;

said combustion engine being operatively connected to said work tool via said clutch;

said clutch having an output side and an engaging speed;

said reset rotational speed being said engaging speed of said clutch; and, said actuating element being configured to use a rotational movement of said output side of said clutch as a positioning movement for resetting said starting enrichment unit.

10. The work apparatus of claim 9, wherein:

said clutch defines a rotational axis;

said cam is arranged on said output side of said clutch and is at an outer distance (f) to said rotational axis of said clutch;

said actuating element is at a distance (e) to said rotational axis; and, said distance (f) is less than said distance (e) when said actuating element is in said unactuated position.

11. The work apparatus of claim 9, wherein:

said clutch has a clutch drum; and, said cam is fixed on said clutch drum.

* * * * *